United States Patent [19]

Moberg et al.

[11] 4,001,919

[45] Jan. 11, 1977

[54] SEAL

[75] Inventors: Sigurd M. Moberg, Orange; George A. Lundberg, Pompton Lakes, both of N.J.

[73] Assignee: E. J. Brooks Company, Newark, N.J.

[22] Filed: May 22, 1974

[21] Appl. No.: 471,828

[52] U.S. Cl. ..... 24/16 PB; 292/318

[51] Int. Cl.[2] ..... B65D 63/00

[58] Field of Search ..... 24/16 PB, 17, 90 W, 24/30.5; 292/318, 320, 322

[56] References Cited

UNITED STATES PATENTS

| | | | |
|---|---|---|---|
| 1,700,744 | 2/1929 | Murry | 292/322 X |
| 3,146,012 | 8/1964 | King | 392/322 X |
| 3,556,575 | 1/1971 | Farkas | 24/16 PB |
| 3,600,027 | 8/1971 | Noland | 24/16 PB |

*Primary Examiner*—Werner H. Schroeder
*Assistant Examiner*—Doris L. Troutman
*Attorney, Agent, or Firm*—Robert E. Ross

[57] ABSTRACT

A security seal formed of molded plastic which is particularly adaped for use with articles closed by staples and hasps, such as are used on a strap closing the neck of a mail bag. The seal components are arranged so that the loop formed by the assembled seal strap may be tightened to a predetermined dimension and no smaller, with the tightening tension not being applied to the point at which the seal is designed to rupture. A finger loop is provided which extends from the loop formed by the assembled seal in such a manner that when the finger loop is pulled, tension is applied directly to the designed rupture point to facilitate removal of the seal.

5 Claims, 4 Drawing Figures

SEAL

BACKGROUND OF THE INVENTION

This invention relates to seals of the type used to seal hasps in enclosures, such as doors of vehicles, merchandise containers, mail bags and the like where the function of the seal is to detect pilferage.

Known seals of this type are formed of a single piece of molded plastic with male and famale fastener portions disposed on opposite ends of an elongated shackle, said fastener portions being adapted for non-separable engagement. A seal of this type is described in U.S. Pat. No. 3,466,077 issued Sept. 9, 1969. This seal has been found to be highly satisfactory in many applications, since to remove the seal, the shackle must be cut, since it is impossible to disengage the interlocking fastener portions without permanent damage thereto. However, it has been found that in situations where personnel must remove hundreds of seals per day to unload the bag contents, the cutting of the seal is time consuming, and the cut seals accumulate on the floor. Some other types of seals used for this purpose are provided with a weakened portion in the shackle, which must be strong enough to resist breaking during normal handling, yet must be weak enough to break readily when tampered with by unauthorized personnel, and to permit rapid removal by authorized personnel. However, it has been found that if the breaking strength is great enough to resist fracture during rough handling, it is great enough to cause sore fingers in the personnel that must open a large number of bags per day.

SUMMARY OF THE INVENTION

The seal disclosed herein comprises a molded socket with a shackle extending therefrom, the portion of the shackle adjacent the socket being in the form of a wide strap, and the distal portion being smaller and having means thereon for non-removable engagement with the socket. In the portion of the shackle immediately adjacent the socket, a weakened portion is provided, which, in one embodiment of the invention, is formed by a transverse slot which does not extend to either edge of the strap. The position of the weakened portion of the strap insures that during assembly, when the shackle is inserted through a staple to retain a hasp in the closed position and the end of the shackle inserted into the socket and pulled tight, very little of the pulling tension is applied to the weakened portion so that the danger of fracturing the seal during assembly is greatly reduced. A finger loop is also provided which extends from the socket in a direction opposite to the direction of the shackle, so that when the finger loop is pulled to fracture the seal, the pulling force is applied directly to the weakened portion of the shackle. The finger loop is provided with a contour that minimizes abrasion to the fingers of employees required to remove the seals.

DESCRIPTION OF THE ILLUSTRATED EMBODIMENT

Figure 1:
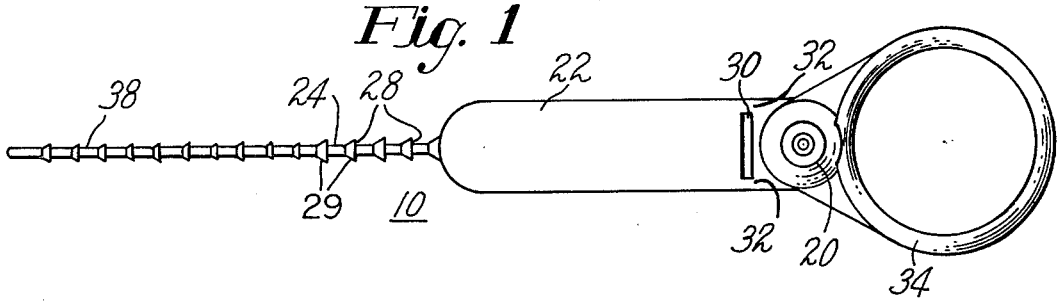
FIG. 1 is a top plan view of a seal embodying the features of the invention.
Figure 2:
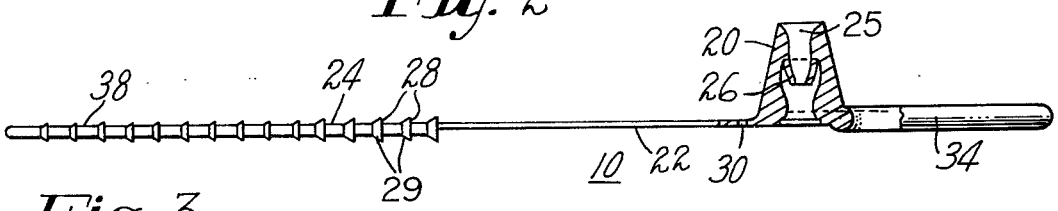
FIG. 2 is a view in side elevation, partly in section, of the seal of FIG. 1.
Figure 3:
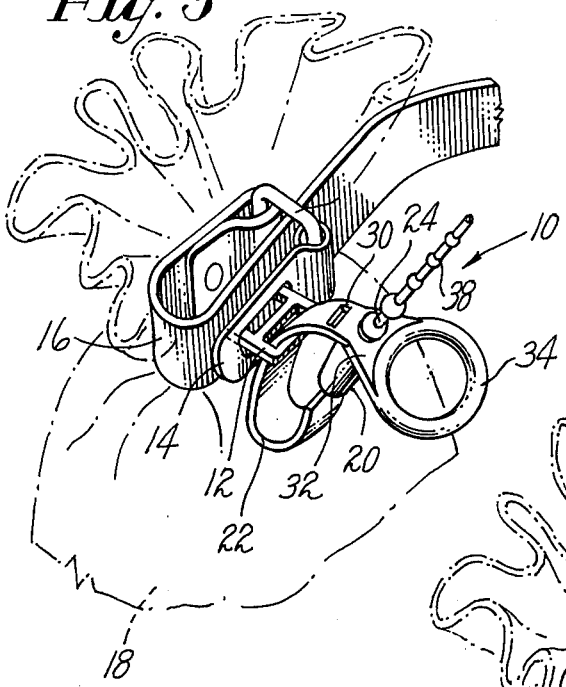
FIG. 3 is a perspective view of the seal of FIG. 1 assembled with the staple and hasp of a mail bag.
Figure 4:
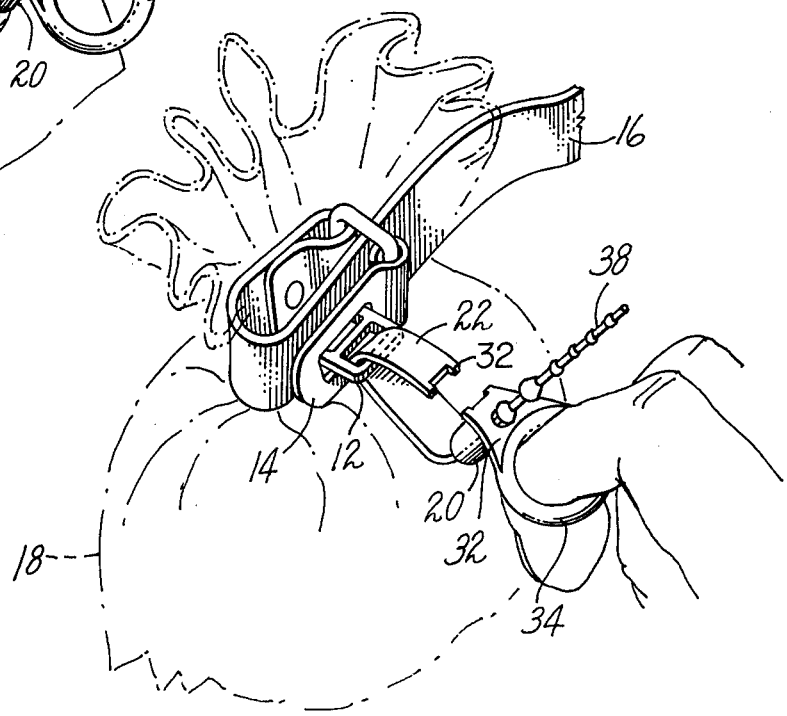
FIG. 4 is a view similar to FIG. 3 illustrating the method of fracturing the seal.

Referring to the drawing, there is illustrated a seal 10 which is particularly adapted for use in sealing, to provide evidence of tampering, a fastener having a staple 12 and hasp 14. The staple and hasp may be assembled onto a strap 16 used to close the mouth of a mail bag 18 or the like.

The seal 10 is preferably formed of a single piece of molded resilient plastic such as polyethylene or polypropylene, and comprises a hollow socket 20, a shackle, said shackle comprising a relatively wide flat band 22 extending from the base of the socket and a smaller end portion 24 extending from the remote end of the band 22.

The socket 20 is generally frusto-conical with a central aperture 25 and internal resilient fingers 26 formed integrally with the aperture walls, said fingers 26 extending toward the base and being inclined inwardly to form a restricted opening therebetween to cooperate with rearwardly facing shoulders 28 formed by enlargements 29 on the end portion 24, so that when said portion enters the socket, the ends of the fingers 26 seat behind the shoulders to lock the shackle in the socket.

The above described and illustrated structure of socket, fingers and end portion 28 of the shackle is similar to that disclosed and claimed in U.S. Pat. No. 3,467,424 issued Sept. 16, 1969, however in the illustrated embodiment the frusto-conical shape of the socket provides a greater rigidity to the structure to resist squeezing or other methods of attempting to deform the socket to release the shackle.

To facilite removal of the seal by authorized personnel, tampering, and to make assembly of the seal easier, to detect a transverse slot 30 is provided in the band 22 closely adjacent the socket 20. The slot has a length in relation to the width of the band such that the portions of the band on opposite sides of the slot are connected only by two narrow portions 32 at the side edges thereof.

To provide means for grasping the seal to effect fracture and disengagement, a finger loop 34 is provided, which extends from the socket in a direction opposite to the band 22 and generally co-planar therewith. The loop is suitably contoured to provide a smooth surface for grasping by a finger.

The seal 10 is readily assembled by passing the end of the shackle through the staple outside of the hasp, and inserting the end of the shackle into the socket. The presence of the slot 30 and its position facilitates the bending of the otherwise somewhat stiff band to get the end of the shackle into position to enter the socket, and insertion of the end of the shackle into the end of the socket is made easier by the concave shape of the top of the socket, which provides a bigger target for the end or the shackle.

The leading end portion 38 of the shackle is free of socket-engaging enlargements for a distance from the end thereof which is greater than the height of the socket. Hence on insertion the end of the shackle protrudes from the opposite end of the socket before an enlarged portion encounters the fingers in the socket. The extreme end of the shackle may be provided with smaller radial protuberances 40 which have a maximum diameter such that they do not resist passing through the socket, but provide a finger-gripping surface to enable completion of the assembly by pulling the shackle through the socket until one of the enlargements 28 engages the fingers 26. In the usual case the shackle will be pulled through the socket until the leading end of the band 22 engages the end of the socket.

The position of the slot 30 is such that very little of the tension applied to the shackle during assembly is applied to the weakened portion, because of the friction of the band passing around the staple, thereby greatly reducing the possibility of accidentally fracturing the seal while it is being assembled.

The position of the slot also facilitates the intentional fracture of the seal, since when the finger loop 34 is pulled, the tension is transmitted directly across the base of the socket to the weakened portion.

When the seal is removed by pulling with a finger, rather than by cutting, the seal remains in one piece for easy disposal, so that no broken pieces of seals fall to the floor, which has been a common complaint with metal seals used heretofore.

Since certain obvious changes may be made in the illustrated embodiment of the invention, it is intended that all matter contained herein be interpreted in an illustrative and not a limiting sense.

We claim:

1. A shackle seal formed of resilient plastic, said seal comprising a housing forming a socket, a shackle extending from the housing, said socket and the remote end of the shackle having means for locking engagement forming a shackle loop when said end is inserted into said socket, and for extending through a device to be sealed, and other means attached to the housing and extending from the housing for grasping for breaking the shackle after the seal is assembled, said other means having an aperture dimensioned to receive a finger.

2. A seal as set out in claim 1 in which a weakened portion is formed in the shackle in a portion thereof adjacent to the housing and remote from the locking means on the opposite end of the shackle.

3. A seal as set out in claim 2 in which the portion of the shackle adjacent the socket is in the form of a flat band and the weakened portion is formed by an aperture in the band adjacent the socket.

4. A shackle seal, comprising a shackle, a housing forming a socket for receiving the end of the shackle to form a shackle loop for extending through a device to be sealed, said shackle having a weakened portion, and a separate loop attached to and extending from the housing, said separate loop being dimensioned to receive a finger for pulling the loop to rupture the seal for removal thereof, said loop being attached to the housing in a position such that the tension resulting when the loop is pulled is applied through the housing directly to the weakened portion of the shackle.

5. A shackle seal comprising a flat band portion having an upwardly extending hollow socket at one end thereof, and a locking end portion extending from the other end of the band, said locking end portion and said socket having interengaging means whereby said end portion may be inserted into one end of the socket in locking engagement therein, said band having a weakened portion formed therein closely adjacent the socket, and a loop integral with and extending from the other side of the socket opposite the inserted band, said loop being substantially co-planar with the band and forming an aperture and receiving a finger to enable the weakened portion to be fractured by pulling the loop to remove the assembled seal.

* * * * *